United States Patent [19]

Kuru et al.

[11] 4,314,242

[45] Feb. 2, 1982

[54] APPARATUS FOR DETECTING A RESIDUAL QUANTITY OF TONER

[75] Inventors: Hiroshi Kuru; Mitsuo Akiyama; Isao Ikemoto, all of Hachioji, Japan

[73] Assignee: Konishiroku Photo Industry Co., Ltd., Tokyo, Japan

[21] Appl. No.: 71,039

[22] Filed: Aug. 30, 1979

[30] Foreign Application Priority Data

Sep. 8, 1978 [JP] Japan ..... 53-110535

[51] Int. Cl.[3] ..... G08B 21/00

[52] U.S. Cl. ..... 340/617; 73/290 V; 310/321; 310/323; 310/338; 340/621

[58] Field of Search ..... 340/617, 603, 612, 621; 73/290 V; 310/338, 321, 328, 323

[56] References Cited

U.S. PATENT DOCUMENTS

| | | | |
|---|---|---|---|
| 2,932,818 | 4/1960 | Lubkin | 73/290 V X |
| 2,990,543 | 6/1961 | Rod | 73/290 V X |
| 3,110,890 | 11/1963 | Westcott et al. | 73/290 V X |

FOREIGN PATENT DOCUMENTS

| | | | |
|---|---|---|---|
| 582760 | 8/1933 | Fed. Rep. of Germany | 340/617 |

OTHER PUBLICATIONS

IBM Tech. Discl. Bull., vol. 15, No. 5, Oct. 1972, "Material Presence Detector", by Kudsi et al., pp. 1545-1546.

*Primary Examiner*—John W. Caldwell, Sr.
*Assistant Examiner*—Daniel Myer
*Attorney, Agent, or Firm*—Bierman & Bierman

[57] ABSTRACT

An apparatus for detecting a residual quantity of toner remaining in the supply hopper of a copying machine includes a piezoelectric vibrating element disposed in a wall of the hopper and having a surface normally positioned in contact with toner in the hopper, and an electronic circuit for causing vibration of the element at a predetermined frequency and for detecting changes in operating characteristics of the element as representative of a decrease in the amount of toner in the hopper to operate a warning device.

6 Claims, 8 Drawing Figures

APPARATUS FOR DETECTING A RESIDUAL QUANTITY OF TONER

BACKGROUND OF THE INVENTION

1. Field of the Invention

The present invention relates to an apparatus for detecting a residual quantity of a toner material contained in a container.

In an electrophotographic copying apparatus, toner contained in a developing device is consumed for every copying operation. Accordingly, it is usually necessary to provide a toner supply device for supplying or replinishing supplementary toner material to the developing device. To this end, the residual quantity of the toner material remaining within the toner supply device is constantly detected, whereby an alarm is produced for informing an operator of the need for additional loading of toner into the toner supply device when the residual toner quantity has decreased to a value below a predetermined level.

2. Description of the Prior Art

As a method of detecting the residual quantity of toner in the toner supply container, it has been hitherto known to measure the weight of toner with the aid of a micro-switch disposed at a bottom of the toner supply container or to detect the residual quantity of toner electrically by making use of the dielectric constant of the toner material.

However, the first mentioned detecting method is disadvantageous in that variation in weight of the toner can not be detected in a stable manner due to the fact that the toner material is inherently of very light weight. On the other hand, the second mentioned detecting method suffers from drawbacks in that a measuring apparatus of large size and complicated structure is required due to the low dielectric constant of the toner material. In brief, the hitherto known detecting methods are disadvantageous in having low sensitivity, poor stability and a degraded reliability.

SUMMARY OF THE INVENTION

With the present invention, it is contemplated to provide a novel apparatus for detecting the residual quantity of a toner material which can assure the intended detection with a high reliability in a stable manner by the use of a vibrating member which is brought into direct contact with the toner. According to a general aspect of the invention, the vibrating member is disposed within a toner supply hopper or alternatively in a wall thereof, wherein the quantity of toner sticking or adhering to the vibrating member is detected in terms of the displacement of the vibrating member by utilizing the resonance frequency $f_o$, sharpness of resonance Q, effective displacement X upon occurrence of the resonance, or like parameters. In the following, the invention will be described in detail by referring to the accompanying drawings.

DETAILED DESCRIPTION OF THE PREFERRED EMBODIMENT

Figure 1:
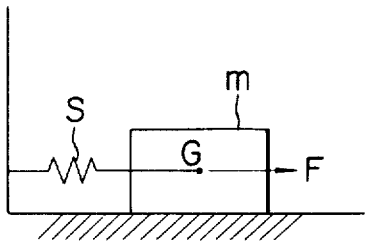
FIG. 1 shows schematically a mechanical vibrating system for convenience of description.

Behaviors of a mechanical vibrating material in respect of the parameters $f_o$, Q and X are well known. For example, assuming that a rigid body having a mass m and the center of gravity G connected to a stationary portion through a spring having a constant S is disposed on a flat surface exhibiting a mechanical resistance r and applied with an external force F at the center of gravity G, as is shown in FIG. 1, then the parameters $f_o$, Q and X of the vibrating rigid body can be given by the following expressions.

$$f_o = \frac{1}{2\pi}\sqrt{\frac{S}{m}}$$

$$Q = \frac{2\pi \cdot f_o \cdot m}{r}$$

$$X = \frac{F}{j\omega r}$$

Figure 2:
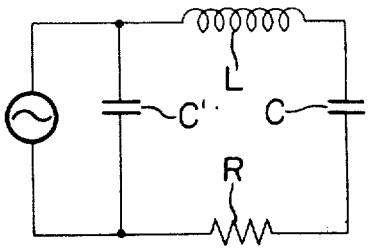
FIG. 2 shows an electrical circuit equivalent to the system shown in FIG. 1.

FIG. 2 shows an electric circuit equivalent to the system illustrated in FIG. 1. Reference letter C' represents a capacitance between electrodes.

By the way, the toner in contact with the vibrating member will increase not only the mass of the vibrating member by adding an additional mass thereto but also the mechanical resistance to vibration due to the viscous resistance and the acoustic resistance of the toner. When the increment in mass is represented by $\Delta m$ with the increment in the mechanical resistance represented by $\Delta r$, the above expressions can be rewritten as follows:

$$f_o = \frac{1}{2\pi}\sqrt{\frac{S}{m + \Delta m}}$$

$$Q = \frac{2\pi \cdot f_o(m + \Delta m)}{r + \Delta r}$$

$$X = \frac{F}{j\omega(r + \Delta r)}$$

Thus, by detecting the variation or displacement of either $f_o$ or Q or X, it is possible to detect the quantity of toner in the toner supply hopper.

For the vibrating member, various alternatives can be used. For example, a plate which vibrates instantaneously in response to application of an external force, a plate which undergoes vibration periodically or instantaneously in response to an external electrostatic or magnetic force, an electrostrictive or magnetostrictive vibrating element which vibrates under self-excitation, or a like element, may be used. In the case where vibration occurs in force, it is possible to detect the toner quantity by measuring the attenuating duration of the induced vibration;

The attenuating duration is decreased when the mechanical resistance $r + \Delta r$ is increased.

Figure 3:
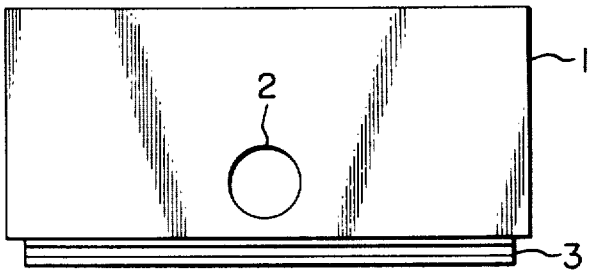
FIG. 3 is a front view of a toner supply container.
Figure 4:
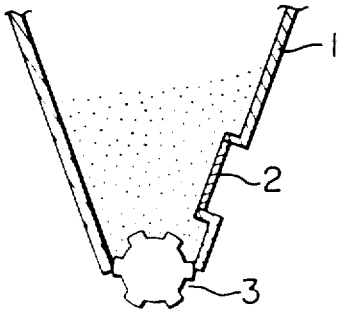
FIG. 4 is a sectional view of the toner supply container.
Figure 5:
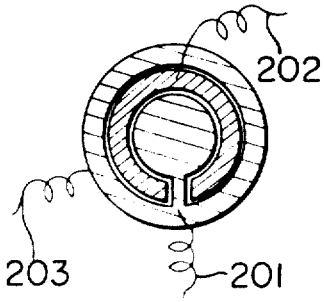
FIG. 5 is a view to illustrate an electrode structure.
Figure 6:
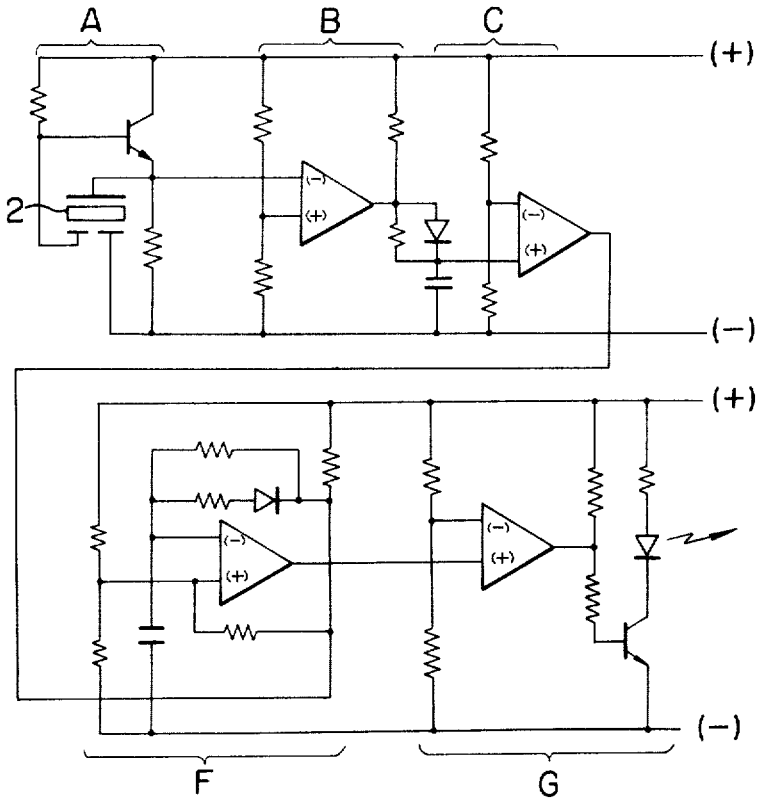
FIG. 6 shows an electrical circuit employed according to the invention.

FIG. 3 shows substantially a front view of a toner supply hopper according to the invention, while FIG. 4 shows a sectional view thereof. In the figures, reference numeral 1 denotes a housing of the toner supply hopper, and 2 denotes an electrostrictive vibrating means or element serving as the vibrating member such as piezoelectric ceramics or crystal. The vibrating element is installed in or on a wall of the hopper so that the surface thereof is in contact with a normal supply quantity of toner. 3 denotes a toner supply roller adapted to supply the toner material to a developing device (not shown) from the toner supply hopper after each occurrence of a predetermined number of copying cycles. The electrostrictive vibrating element 2 is constituted by a thin disc of a piezoelectric ceramic provided with electrodes for effecting vibration of the ceramic at both surfaces thereof. One side surface of the disc-like vibrating element is divided into two electrodes made, for example, of silver coating attached with respective lead wires 201 and 202—while the other surface constitutes a single electrode to which a lead wire 203 is connected. The lead wires are connected to a voltage source (not shown) for vibration. The single electrode is made of an electric conductor such as thin phosphorus bronze plate or brass plate. The single electrode serves to change the moving direction of the piezoelectric element so that it is reciprocally moved, in a direction perpendicular to the surface thereof—when the supplying voltage, for example, in a range of from 0.01 to 100 volts—is supplied to the opposite electrodes. In this embodiment, the vibrating element is regulated so that it is not vibrated when more than half of its surface is covered up with the toner material, and it is vibrated when the toner level is decreased below a predetermined level on the surface of the element. This is accomplished utilizing various kinds of elements such as the resistors and transistor in the oscillating circuit A (FIG. 6), and by the thickness of the single electrode and the like. With a view to enhancing the detection efficiency, the mass or weight of the electrostrictive vibrator element for a unit area is so determined in consideration of the toner density that the mass for a unit area is small, a proper adhering property of the toner to the electrostrictive vibrator element is maintained, and the mechanical resistance r will not be unnecessarily increased due to the presence of a bonding agent used to mount the electrostrictive element on a side wall of the hopper. It goes without saying that the vibrating element is a thin electrically conductive plate, when a magnetostrictive vibrating element (not shown) comprising the thin electrical conductive plate, a core connected to the plate, and a coil surrounding the core is used. The lead wires 201, 202 and 203 are connected to an electric circuit shown in FIG. 6.

Figure 7:
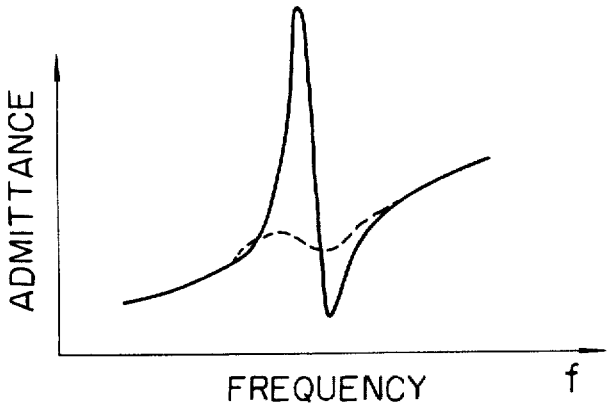
FIG. 7 illustrates graphically vibrating frequency-admittance characteristics and FIG. 8 shows a signal wave diagram illustrating signal waves produced in the circuit shown in FIG. 6.

The electric circuit comprises an oscillation circuit A for bringing about vibration of the electrostrictive vibrator element 2, a detector circuit B for detecting whether the electrostrictive vibrating element 2 is vibrating or not, an integrating circuit C for converting the output from the detector circuit B into a D.C. signal, a flash circuit F for turning on and off the output from the integrating circuit C at a predetermined time interval, and an LED drive circuit G for turning on and off the light emitting diode (LED) in dependence on the output from the flash circuit F. When the electrostrictive vibrating element 2 is not in contact with the toner material, there will arise a remarkable difference in admittance as compared to the state in which the vibrating element 2 is in contact with the toner material due to the variation of the parameters $f_o$, Q and X described above, as will be seen from the vibrating frequency-admittance characteristic curves shown in FIG. 7 in which the admittance measured in the contact-with-toner state is indicated by a broken line. According to the teaching of the invention, the difference in admittance described above is utilized for determining the various parameters or constants of respective elements such as the electrode array of the electrostrictive vibrating element 2, the resistance of the oscillator circuit A, and for choosing the type of transistors or the like so that the vibrator element vibrates when it is not in contact with the toner and does not vibrate when the vibrator element is in contact with the toner.

In this embodiment, value or displacement of the reasonance frequency $f_o$, sharpness of resonance Q and effective displacement X for detecting the quantity of the toner remaining in the hopper are obtained as based on their values when the toner is in contact with the vibrator means. For example, the sharpness of resonance Q is substantially obtained by the difference between maximum and minimum values of the admittance shown by the full and broken lines, and the resonance frequency $f_o$ is substantially obtained by the difference in frequencies of the full and broken lines showing maximum and minimum values of the admittance, all seen in FIG. 7. Furthermore, value or displacement X of a position of the vibrating element is obtained by comparing with a predetermined value.

Figure 8:
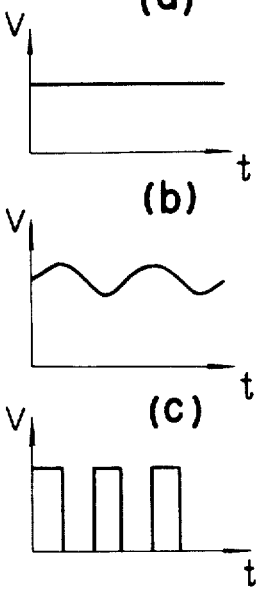

When the electrostrictive vibrating element 2 is not vibrating, the detector circuit B will produce the D.C. voltage signal wave shown in FIG. 8 at (a). On the other hand, when the element 2 is vibrating, the detector circuit B will produce an A.C. voltage wave such as shown in FIG. 8 at (b), whereby vibration is detected. When the electrostrictive vibrating element 2 is vibrating, the flash circuit F produces a pulse output shown at (c) to the LED drive circuit G to intermittently energize the LED to alarm or warn an operator of the need for supplying additional toner to the toner supply hopper.

The above described arrangement allows the detection of the residual quantity of toner with a high sensitivity in a stable manner. The detecting device can be implemented in a small size with a simplified structure.

What is claimed is:

1. Apparatus for detecting a residual quantity of a toner material in the toner supply hopper of an electrophotographic copying apparatus, the toner supply hopper including at least a wall in contact with toner material in the hopper, said apparatus comprising:

a vibrating element disposed in and forming an integral portion of the wall of the toner supply hopper so that one surface of the vibrating element is normally positioned in contact with toner material contained in the hopper; and electronic circuit means connected with said vibrating element for effecting vibration thereof at a predetermined frequency and for detecting a change in the operating characteristics of said element, said circuit means further including warning means for indicating said change so as to signal a decrease in the amount of toner material in the supply hopper;

said vibrating element comprising a piezoelectric plate integrally disposed in the wall of the toner supply hopper, and electrodes on oppositely-disposed faces of said piezoelectric plate such that at least one of the electrodes is normally disposed in contact with toner material contained in the supply hopper, said electronic circuit means being connected to the vibrating element at said electrodes, and said vibrating element further comprising a pair of electrodes on one face of said piezoelectric plate and a single electrode on the opposite face of said plate, said electronic circuit means causing a voltage to be applied to said pair of electrodes and said single electrode enabling vibration of the piezoelectric plate in a direction substantially perpendicular to the oppositely-disposed faces thereof when a voltage is applied to said electrode pair.

2. Apparatus in accordance with claim 1, wherein the two electrodes of said electrode pair on said one face of the piezoelectric plate are disposed substantially coaxially with respect to each other.

3. Apparatus in accordance with claim 1, said vibrating element being arranged for vibration when the toner material contained in the supply hopper covers less than a predetermined portion of its surface area normally in contact with the toner material, and against vibration when more than said predetermined portion of its surface area is covered by the toner material.

4. Apparatus in accordance with claim 1, said circuit means measuring a change in the resonant frequency of the vibrating element at a selected admittance for signalling a decrease in the amount of toner material contained in the supply hopper.

5. Apparatus in accordance with claim 1, said circuit means measuring a change in the sharpness of resonance of the vibrating element at a selected admittance for signalling a decrease in the amount of toner material contained in the supply hopper.

6. Apparatus in accordance with claim 1, said circuit means measuring a change in the positional displacement of said vibrating element for signalling a decrease in the amount of toner material contained in the supply hopper.

* * * * *